US008016666B2

(12) United States Patent
Angell et al.

(10) Patent No.: US 8,016,666 B2
(45) Date of Patent: Sep. 13, 2011

(54) LINKING COMPONENT, SYSTEM, AND METHOD FOR PROVIDING ADDITIONAL SERVICES AT A GAMING MACHINE

(75) Inventors: Robert C. Angell, West Greenwich, RI (US); Ronald D. Deangelis, Wakefield, RI (US); Edward J. Hole, Jr., Portsmouth, RI (US); Richard L. Martin, Alpharetta, GA (US); John A. Santini, Jr., Wakefield, RI (US); Shawn Terry, Preston, CT (US)

(73) Assignee: Oneida Indian Nation, Oneida, NY (US)

( * ) Notice: Subject to any disclaimer, the term of this patent is extended or adjusted under 35 U.S.C. 154(b) by 2218 days.

(21) Appl. No.: 10/231,457

(22) Filed: Aug. 30, 2002

(65) Prior Publication Data

US 2004/0043814 A1 Mar. 4, 2004

(51) Int. Cl.
*A63F 9/24* (2006.01)

(52) U.S. Cl. ..... 463/25; 463/29

(58) Field of Classification Search ..... 463/25, 463/29; 235/379
See application file for complete search history.

(56) References Cited

U.S. PATENT DOCUMENTS

| | | | | |
|---|---|---|---|---|
| 4,669,596 | A | 6/1987 | Capers et al. | 194/210 |
| 5,091,713 | A | 2/1992 | Horne et al. | 340/541 |
| 5,429,361 | A | 7/1995 | Raven et al. | 273/138 A |
| 5,440,108 | A | 8/1995 | Tran et al. | 235/381 |
| 5,470,079 | A | 11/1995 | LeStrange et al. | |
| 5,524,888 | A | 6/1996 | Heidel | |
| 5,679,945 | A | 10/1997 | Renner et al. | 235/492 |
| 5,697,482 | A | 12/1997 | Orus et al. | |
| 5,919,091 | A | 7/1999 | Bell et al. | |
| 5,955,718 | A | 9/1999 | Levasseur et al. | 235/381 |
| 6,019,283 | A | 2/2000 | Lucero | |
| 6,068,101 | A | 5/2000 | Dickenson et al. | 194/206 |
| 6,125,405 | A | 9/2000 | Farges | 710/2 |
| 6,219,836 | B1 | 4/2001 | Wells et al. | 717/11 |
| 6,223,984 | B1 | 5/2001 | Renner et al. | 235/380 |
| 6,511,377 | B1 * | 1/2003 | Weiss | 463/25 |
| 6,852,029 | B2 * | 2/2005 | Baltz et al. | 463/25 |
| 2002/0034299 | A1 | 3/2002 | Charrin | |
| 2003/0014370 | A1 * | 1/2003 | Charrin | 705/65 |

FOREIGN PATENT DOCUMENTS

EP 0 534 718 A2 3/1993

(Continued)

OTHER PUBLICATIONS

Instant Keno Specification; multiple drafts captioned "Keno" and "Instant Keno," undated (38 pages).

(Continued)

*Primary Examiner* — David L Lewis
*Assistant Examiner* — Omkar Deodhar
(74) *Attorney, Agent, or Firm* — DeLizio Gilliam, PLLC

(57) ABSTRACT

Methods and apparatus consistent with the present invention provide additional services, such as cashless gaming and player tracking, at a gaming machine. One such gaming machine includes a game processor, a peripheral device, and a linking component connected between the game processor and the peripheral device. The linking component emulates or relays communication signals sent between the game processor and the peripheral device using the communication protocol used for communication between the game processor and the peripheral device.

49 Claims, 13 Drawing Sheets

FOREIGN PATENT DOCUMENTS

| | | | |
|---|---|---|---|
| EP | 1 074 955 | A2 | 2/2001 |
| GB | 2366896 | A | 3/2002 |
| WO | WO 96/30857 | | 10/1996 |
| WO | WO 99/60498 | | 11/1999 |

OTHER PUBLICATIONS

Imagineering Systems, Inc., "Instant Keno—Cashless Automated Keno Writer Stations," undated (6 pages).
Imagineering Systems, Inc., "The Keno People," undated (2 pages).
Bruce T. Samboy letter to Hon. Richard F. Corbisiero, Jr. dated Jun. 1, 1994, "Review of Instant Keno" (6 pages).
Bruce T. Samboy letter to Carl Conti dated Jun. 13, 1994 (2 pages).
Bruce T. Samboy letter to Hon. Richard F. Corbisiero, Jr. dated Jun. 14, 1994, "Recommendations Concerning Instant Keno" (7 pages).
Katherine A. Smith letter to Hon. James R. Hurley dated Jun. 15, 1994, "Imagineering Computerized Keno System" (4 pages).
Jacqueline L. Minder letter to Ron Mach dated Jun. 20, 1994 (1 page).
Carl Conti letter to Bruce T. Samboy dated Jun. 27, 1994 (2 pages).
Bruce T. Samboy letter to Carl Conti dated Jul. 1, 1994, "Imagineering—Instant Keno and Gaming Enterprise Registration" (2 pages).
Niels C. Holch letter to Hon. Richard F. Corbisiero, Jr. dated Jul. 12, 1994 (1 page).
Hon. Richard F. Corbisiero, Jr. letter to Niels C. Holch dated Jul. 14, 1994 (1 page).
"High-Tech Gambling Debuts at Turning Stone," Syracuse Post Standard, Feb. 27, 1995 (1 page).
Turning Stone Inter-Office Memorandum to Bong Woo from Susan Gatley dated Oct. 17, 1994, re Instant Keno Issues (3 pages).
Turning Stone Inter-Office Memorandum to Bruce Samboy re Instant Keno, Observations and Recommendations, dated Nov. 8, 1994 (2 pages).

* cited by examiner

LINKING COMPONENT, SYSTEM, AND METHOD FOR PROVIDING ADDITIONAL SERVICES AT A GAMING MACHINE

BACKGROUND OF THE INVENTION

1. Field of the Invention

The present invention relates generally to the field of gaming and, more particularly, to a linking component, system, and method for providing additional services, such as cashless gaming and player tracking, at a gaming machine.

2. Background Information

Gaming machines, such as spinning reel slot machines, typically accept only coins or cash as monetary input for gaming. FIG. 1A is a block diagram of an exemplary cash-only gaming machine 100. As shown, gaming machine 100 includes a game processor 102, which includes game software 120, and game peripheral devices 118, which include a game display 104, an audio device 106, a bill acceptor 108, a coin acceptor 110, a coin hopper 112, one or more buttons 114, and other gaming devices 116 (such as hard meters).

Game processor 102 typically communicates with and controls peripheral devices 118. In addition, game processor 102 runs game software 120, which has been certified by governmental gaming regulators to ensure compliance with governmental regulations on gaming. Among other things, game software 120 controls the number of wins and losses. In order to prevent modification of game software 120 following the certification process, regulators will usually seal the housing containing the game processor with, for example, a tamper-proof tape. If the seal is broken, game processor 102 and game software 120 must undergo another review by the governmental gaming regulators.

Game display 104 displays game information, such as entertaining graphics (e.g., spinning reels) and/or the outcome of a game, to players. Game display 104 may include, for example, a video monitor, mechanical reels, an LED display, or even a touch screen video monitor for displaying video graphics and receiving player inputs.

Audio device 106 presents audio, such as bells, whistles, and other sounds, to players. Audio device 106 may comprise, for example, a audio card, amplifier, and/or speaker.

Bill acceptor 108 accepts and validates bills in one or more denominations. Similarly, coin acceptor 110 accepts and validates coins in one or more denominations. Coin acceptor 110 may comprise, for example, a coin comparator or a coin mechanism. Coin acceptor 110 may divert incoming coins to coin hopper 112. Coin hopper 112 comprises a coin bucket located inside gaming machine 100, which holds several hundred coins and is capable of accurately dispensing the proper quantity of coins to a winning player. In addition, coin hopper 112 may include a sensor (not shown) that detects when coin hopper 112 overfills and causes coin hopper 112 to dispense extra coins into a drop bucket (not shown) in the gaming machine 100. Gaming facility personnel later collect the coins in the drop bucket.

Gaming machine 100 also includes buttons 114 or other devices, such as a touch screen, for accepting player inputs. Buttons 114 may include, for example, "Bet One Credit," "Bet Max Credits," and "Cash Out," and other buttons that enable a player to initiate game play, enter a wager amount, and/or cash out. Finally, gaming machine 100 may include any number of other gaming devices 116, such as hard meters to record, for example, the amount of winnings on gaming machine 100.

Cash-only gaming machines like the one depicted in FIG. 1A suffer many problems. For example, casinos and other gaming facilities have to spend large amounts of money a year to maintain the machines due to mechanical problems related to accepting and dispensing coins and bills. These same facilities must pay higher operating and security costs, paying for employees to fill and empty gaming machine drop buckets and coin hoppers, transport the coins and bills to a counting room, count or weigh the coins, transport the coins and bills to a vault, and issue the coins and bills to cashiers. Furthermore, cash-only machines make it difficult for players to move from one machine to the next. If, for example, a player wishes to move from a slot machine to a video poker machine, he must cash out of the slot machine, perhaps receiving a load of coins as payment for winning, and carry the coins to the video poker machine to begin to play again. Not only is it cumbersome for the player to carry a large number of coins, but also the player loses playing time and risks dropping coins or theft while carrying them to the other machine. The gaming facility may also lose revenue from the lost playing time. The problem is exacerbated when a player attempts to move between gaming machines that accept different coin or bill denominations. Still another problem with these cash-only gaming machines is that these machines may not provide additional services, such as player tracking.

Due to the above-mentioned problems with the cash-only gaming machines, many gaming machines have been developed to provide cashless gaming, for example, gaming that uses electronic funds transfer, credit cards, and account-based payment, and/or to provide additional services, such as player tracking. Some of these gaming machines have been designed to retrofit existing gaming machines to accept these new forms of payment and/or to provide additional services, such as player tracking. These "retrofit" machines require updating game software 120 or otherwise modifying game processor 102.

FIG. 1B is a block diagram of such a retrofit gaming machine 130. Gaming machine 130 is similar to gaming machine 100 in that it provides cash gaming. Gaming machine 130, however, also provides player tracking functions, such as tracking the amount of money a player has bet. Like gaming machine 100, gaming machine 130 includes a game processor 102, which includes game software 120, and game peripheral devices 118, which include a game display 104, an audio device 106, a bill acceptor 108, a coin acceptor 110, a coin hopper 112, one or more buttons 114, and other gaming devices 116 (such as hard meters). As shown in FIG. 1B, game software 120 needs to be modified to provide player tracking functions.

In addition, gaming machine 130 includes a player tracking processor 122, a display device 124, a card reader 126, and a keypad 128 to provide player tracking functions. Player tracking processor 122 may include any device that communicates with game processor 102 and a player tracking computer (not shown) to provide various player tracking functions, such as tracking the amount of money a player has bet and issuing points to the player based on that amount. Display device 124 may display various kinds of information to the player, such as the number of points in the player's account. Card reader 126 may include any card reader that reads information from a card. Keypad 128 may include a device for entering a password, personal identification number (PIN), and/or other information.

These retrofit machines, however, have problems of their own. First, changes to game software 120 are expensive and time consuming to make. Moreover, the software upgrades required to convert the gaming machines vary from vendor to vendor, making it difficult to develop a standard software upgrade that will work with every gaming machine. Furthermore, changes to the game software may change game performance, game look and feel, and pay tables or outcomes, which may result in dissatisfied players. Finally, changes to game software 120 and game processor 102 would require breaking the seal of the housing containing game processor 102, which would in turn require re-certification of the game software 120 by governmental gaming regulators. Such re-certification may be expensive and time consuming.

SUMMARY OF THE INVENTION

A method consistent with the present invention may provide cashless gaming in a gaming machine that includes a game processor, a cash acceptor, and a cash dispenser. A communication indicating that a player of the gaming machine has selected a wager amount may be received from the cash acceptor and a communication representing a deposit of cash in the amount of the wager using a communication protocol used for communication between the cash acceptor and the game processor may be emulated to the game processor. In addition, a payout instruction to dispense cash to the player may be received from the game processor and a communication representing a payout of cash in an amount corresponding to the payout instruction using a communication protocol used for communication between the cash dispenser and the game processor may be emulated to the game processor.

Another method consistent with the present invention may provide cashless gaming by intercepting a communication designed to go from a peripheral device in a gaming machine to a game processor in the gaming machine, instructing a transaction processor, external to the gaming machine, that stores a player's account balance to adjust the player's account balance, emulating a communication using a communication protocol used for communication between the peripheral device and the game processor, and sending the communication to the game processor.

Still another method consistent with the present invention may provide for converting a cash-only gaming machine into a machine that is capable of providing cashless play. The gaming machine may include a game processor and a peripheral device. Consistent with this method, a communication protocol between the game processor and the peripheral device may be determined. In addition, a linking component may be connected between the game processor and the peripheral device and configured to emulate the communication protocol between the game processor and the peripheral device.

Yet another method consistent with the present invention may provide for cashless play at a gaming machine. The gaming machine may include a game processor and a peripheral device. Consistent with this method, a linking component may be connected between the game processor and the peripheral device and the communication protocol used for communication between the game processor and the peripheral device may be determined. In addition, the linking component may receive a communication signal intended for the game processor from the peripheral device and may send a new communication signal to the peripheral device using the determined communication protocol.

Moreover, another method consistent with the present invention may provide for additional services at a gaming machine. The gaming machine may include a game processor and a peripheral device. Consistent with this method, a linking component may be connected between the game processor and the peripheral device and the communication protocol used for communication between the game processor and the peripheral device may be determined. In addition, communication between the game processor and the peripheral device may be emulated using the communication protocol to provide additional services at the gaming machine in a manner that is transparent to the game processor and the peripheral device, wherein the additional services include at least one of player tracking, amenity services (e.g., making dinner reservations), e-commerce, and locating a player in a gaming facility.

Moreover, a gaming machine consistent with the present invention may providing cashless gaming. Such a gaming machine may include a game processor, a cash acceptor, a cash dispenser, and a linking component. The linking component may include means for receiving a communication from the cash acceptor indicating that a player of the gaming machine has selected a wager amount, means for emulating a communication to the game processor representing a deposit of cash in the amount of the wager using a communication protocol used for communication between the cash acceptor and the game processor, means for receiving a payout instruction from the game processor to dispense cash to the player, and means for emulating a communication to the game processor representing a payout of cash in an amount corresponding to the payout instruction using a communication protocol used for communication between the cash dispenser and the game processor.

Furthermore, a gaming machine consistent with the present invention may provide cashless gaming. The gaming machine may include a game processor, a cash acceptor, and a linking component. The linking component may include a transaction processor interface to send a request corresponding to the wager to a transaction processor, external to the gaming machine, that stores a player's account balance and receive a confirmation from the transaction processor indicating that an amount corresponding to the wager has been deducted from a player's account, a processor to emulate a deposit communication representing deposit of cash in the amount of the wager, and a game processor interface to send the deposit communication to the game processor.

In addition, a cash-only gaming machine consistent with the present invention may provide cashless play. The cash-only gaming machine may include a game processor, a peripheral device, and a linking component connected between the game processor and the peripheral device. The linking component may receive a communication signal intended for the game processor from the peripheral device and may send a new communication signal using the communication protocol used for communication between the game processor and the peripheral device.

Furthermore, another gaming machine that is capable of tracking activity consistent with the present invention may include a game processor, a peripheral device, and a linking component connected between the game processor and the peripheral device. The linking component may collect player tracking data in a manner that is transparent to the game processor and the peripheral device, and send the player tracking data to a player tracking computer external to the gaming machine. The player tracking data may include at least one of player activity (e.g., unique identifiers, wagers, and win amounts), game activity (e.g., wins, losses, and other desired statistics), and gaming machine activity (e.g., counting the total number of door opens).

Moreover, a linking component consistent with the present invention may be used in a cash-only gaming machine for converting the cash-only gaming machine into a machine that is capable of providing cashless play. The gaming machine may include a game processor and a peripheral device. The linking component may include one or more interfaces to receive signals from the game processor and the peripheral device, a memory including instructions for interpreting a communication signal from the game processor, interpreting a communication signal from the peripheral device, and sending a new communication signal using the communication protocol used for communication between the game processor and the peripheral device, and a processor that executes the instructions in the memory.

Furthermore, a system consistent with the present invention may provide cashless gaming. The system may include a transaction processor that stores player account information, including a player identifier and an account balance, for a plurality of players, and a gaming machine. The gaming machine may include a game processor, a peripheral device, and a retrofitted linking component interconnected between the game processor and the peripheral device, wherein the linking component sends a player identifier to the transaction processor and emulates signals between the game processor and the peripheral device to provide cashless gaming in a manner that is transparent to the game processor.

In addition, a computer-readable medium consistent with the present invention may contain instructions for causing a cash-only gaming machine to perform a method of providing cashless play. The cash-only gaming machine may include a game processor, a peripheral device, and a linking component connected between the game processor and the peripheral device. The method may include interpreting a communication signal from the game processor, interpreting a communication signal from the peripheral device, and sending a new communication signal using the communication protocol used for communication between the game processor and the peripheral device.

Both the foregoing and the following description are exemplary and explanatory, and are intended to provide further explanation of the claimed invention as opposed to limiting it in any manner.

BRIEF DESCRIPTION OF THE DRAWINGS

The accompanying drawings are incorporated in and constitute a part of this specification and, together with the description, explain the principles of the invention. In the drawings.

DETAILED DESCRIPTION

Methods and systems consistent with the present invention modify gaming machines to provide additional services, such as cashless gaming, player tracking, e-commerce, and locating another player in a gaming facility, without unsealing the game processor housing or updating the game software. As used herein, cashless gaming may include, but is not limited to, gaming that is cashless, coinless, uses electronic funds transfer, uses credit cards, uses account-based payment, or uses coupons or tickets. The term "cash" as used herein refers to coins, tokens, bills and other non-personalized monetary input to gaming machines.

Consistent with the present invention, these enhanced capabilities are provided by modifying a gaming machine to include a linking component for communicating with a transaction processor. The transaction processor stores player account information (including, for example, a unique player identifier and a player account balance) for each player. During gaming, the linking component emulates the necessary communication between the game processor and the peripheral devices of the gaming machine to provide cashless gaming and other services that are transparent to the game processor and the peripheral devices. For example, when the player selects a wager amount (e.g., by pressing one of the buttons, such as the "Bet One Credit" or "Bet Max Credit" buttons), the pressed button sends an appropriate signal. The linking component preferably intercepts this signal and sends a request for credit equivalent to the wager amount to the transaction processor. The transaction processor deducts the wager amount from the player's account balance and may send a confirmation to the linking component. In response, the linking component sends a "coin deposit" signal (or a "bill deposit" signal as desired) corresponding to the wager amount to the game processor of the gaming machine. The game processor then provides for game play as in cash-only gaming machines. In this way, the linking component may modify a cash-only gaming machine such that it can provide cashless gaming in addition to cash gaming without requiring changes to the game processor, game software, or peripheral devices. Methods and systems consistent with the present invention are not limited to use in a casino, but rather may be used in any facility that provides gaming, such as hotels, motels, amusement parks, theme parks, casinos, and resorts.

Figure 1A:
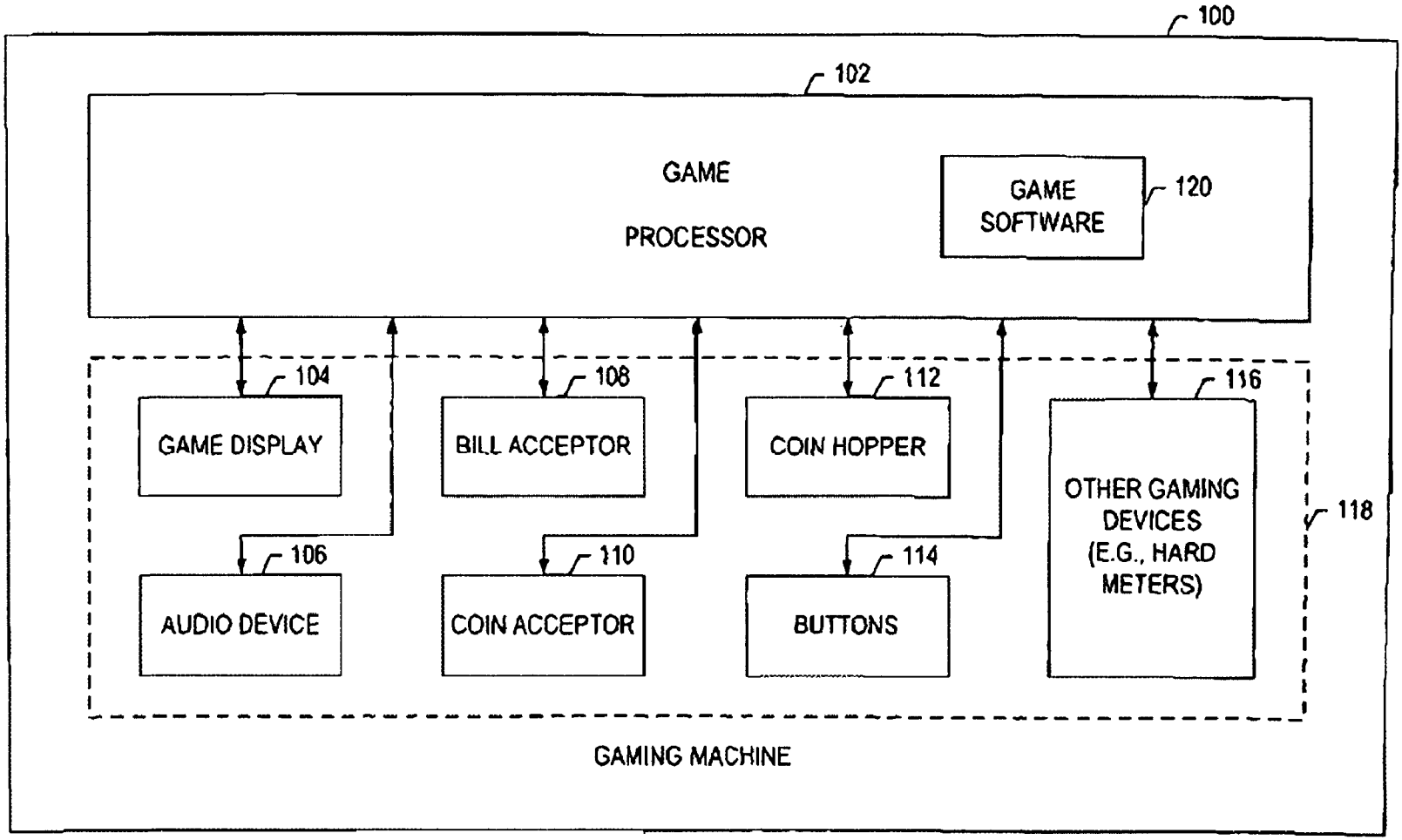
FIGURE 1A (PRIOR ART)
FIG. 1A is a block diagram of a cash-only gaming machine.
Figure 1B:
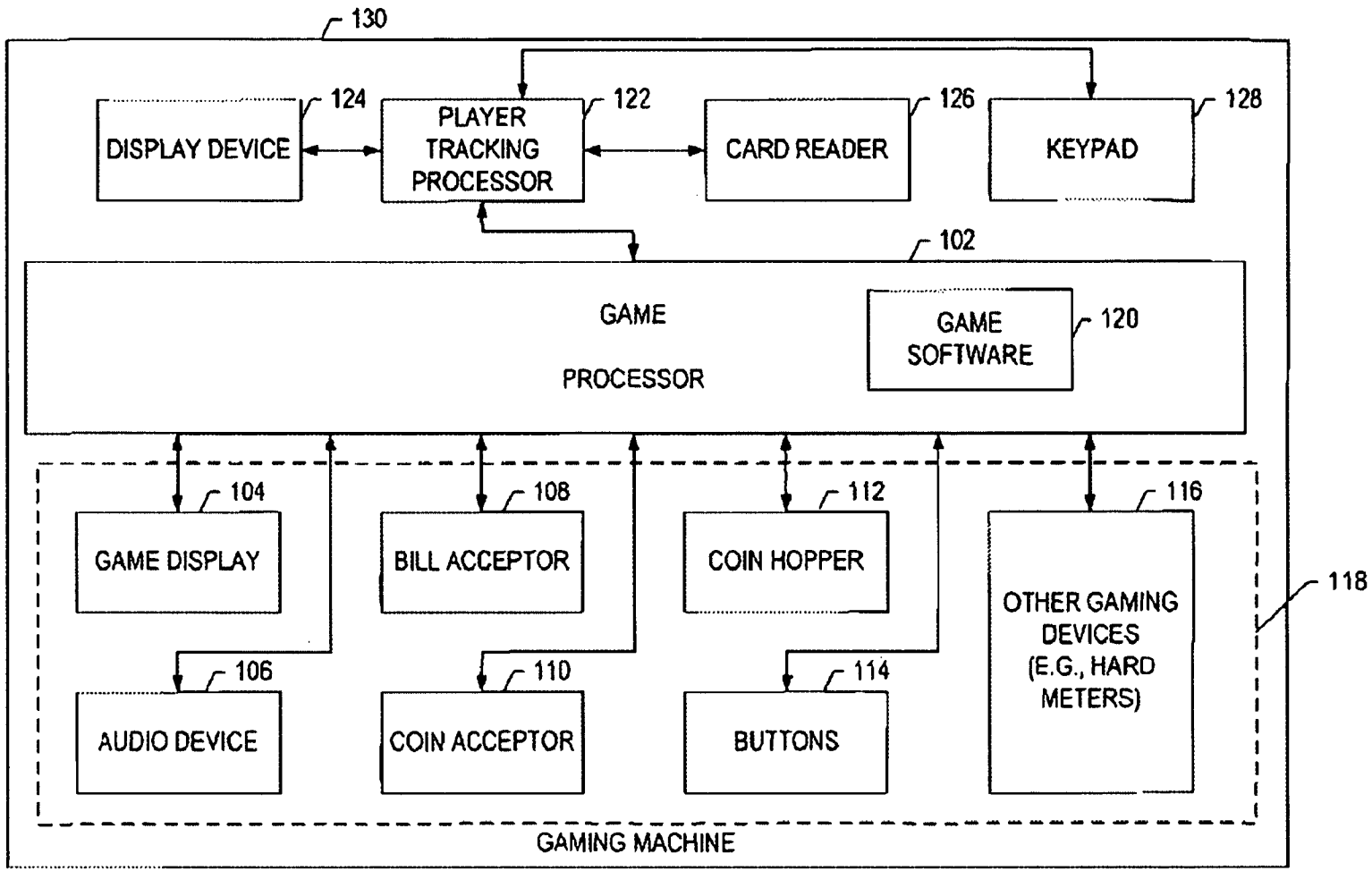
FIGURE 1B (PRIOR ART)
FIG. 1B is a block diagram of a cash-only and player tracking gaming machine.
Figure 2:
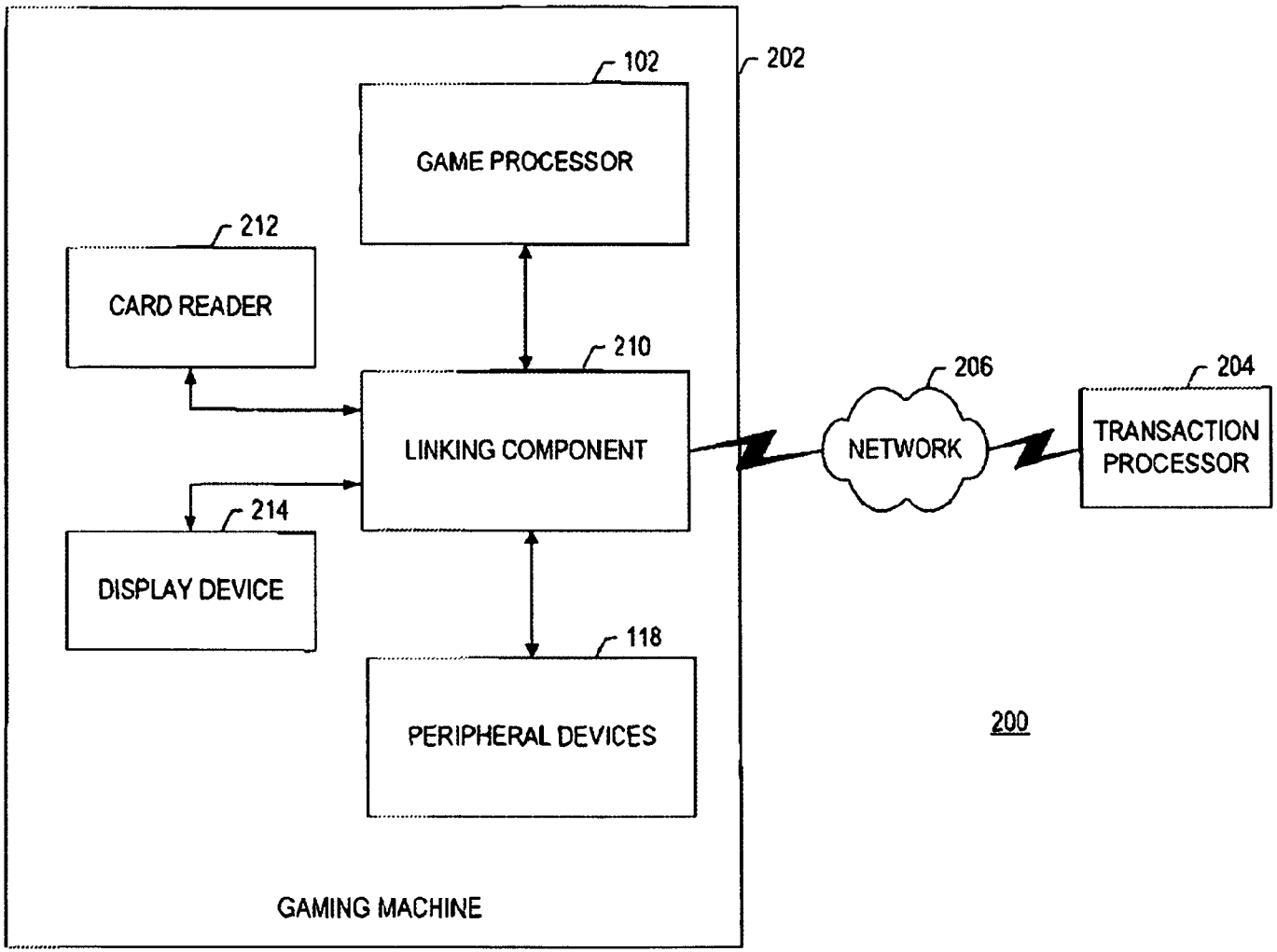
FIG. 2 is a block diagram of an exemplary gaming system in which a cash-only gaming machine is modified consistent with the present invention.

FIG. 2 is a block diagram of an exemplary gaming system 200 in which a cash-only gaming machine is modified consistent with the present invention. As shown, system 200 may include one or more modified gaming machines 202 and a transaction processor 204, which are interconnected by a network 206. Gaming machine 202 includes a game processor 102, a linking component 210, a card reader 212, a display device 214, and peripheral devices 118. Game processor 102 and peripheral devices 118 may be of any type found in gaming machines, such as the ones shown in FIGS. 1A and 1B.

Linking component 210 intercepts and emulates communications between game processor 102 and peripheral devices 118 to provide cashless gaming and other services that are transparent to game processor 102 and peripheral devices 118. In one embodiment, linking component 210 may include a PC/104 board available, for example, from ZF Micro Solutions, Inc. or Tri-M Systems.

Card reader 212 may include any device used to read and/or write information to a card and to enable cashless gaming and other services at gaming machine 202. For example, card reader 212 may be used to read information from a magnetic card assigned to the player by the gaming facility or from the player's credit card. Card reader 212 may include a magnetic card reader or a smart card reader. Card reader 212 may read player account information from a card and send it to transaction processor 204. Display device 214 may display various kinds of information to a player, such as an account balance or instructions on how to begin a game on gaming machine 202.

As shown in FIG. 2, linking component 210 is connected to a transaction processor 204. Transaction processor 204 may include a computer or a similar device that facilitates cashless gaming and other services at one or more gaming machines 202. For example, transaction processor 204 may store account information, such as a unique player identifier and an account balance, for each player. When a player inserts a cashless play card into card reader 212, linking component 210 sends the player's unique identifier to transaction processor 204. Transaction processor 204 may then send account information corresponding to the received identification number to linking component 210 to enable cashless play. Transaction processor 204 may provide cashless gaming in accordance with the inventions described in U.S. Pat. No. 5,674,128, U.S. Pat. No. 5,800,269, U.S. Pat. No. 6,089,982, U.S. Pat. No. 6,280,328, and/or U.S. patent application Ser. No. 09/921,782, filed Aug. 6, 2001, entitled "Cashless Computerized Video Game System and Method," all of which are incorporated herein by reference.

In addition to providing cashless gaming, linking component 210 and transaction processor 204 may provide various other services to players. For example, linking component 210 may gather data for player tracking by transaction processor 204. Linking component 210 may also perform machine accounting, such as counting the total number of door opens, wins, losses, and other desired statistics, for gaming machine 202 on a daily or other basis. Linking component 210 may upload the totals to transaction processor 204 on a daily or other basis.

Moreover, linking component 210 and transaction processor 204 may facilitate such amenity and player locator features as disclosed in co-pending U.S. patent application Ser. No. 09/488,556, filed on Jan. 21, 2000, entitled "Interactive Resort Operating System," and U.S. patent application Ser. No. 09/689,842, filed Oct. 13, 2000, entitled "System, Method, and Article of Manufacture for Locating and Communicating with a Player at a Hospitality Facility," both incorporated herein by reference. For example, as explained in U.S. patent application Ser. No. 09/689,842, to locate a player, each location in the gaming facility (e.g., restaurant, hotel lobby, and hotel room) may include a unique location identifier and a receiving device (such as a card reader or a receiver). Whenever a player enters or exits a location, the receiving device may receive, the unique identifier, from the player (e.g., through the card assigned to the player). Then, the receiving device may send, for example, to a computer such as transaction processor 204, both the unique identifier and the location identifier for storage. As a result, each location visited by the patron may be tracked and another player or the gaming facility may locate or communicate with a particular patron using the stored location identifier data on transaction processor 204.

Network 206 may include a single or a combination of any type of computer network, such as a Local Area Network (LAN) or a Wide Area Network (WAN). For example, network 206 may comprise an Ethernet network according to the IEEE 802.3 standard. Network 206 may include a private or a public network, such as the Internet.

It will be apparent to one skilled in the art that although depicted separately in FIG. 2, linking component 210, card reader 212, and display device 214 may be combined into a single unit for placement in or near gaming machine 202. Moreover, it will be apparent to one skilled in the art that various modifications may be made to system 200 without departing from the scope of the present invention. For example, although linking component 210 as shown in FIG. 2 is connected to all existing peripheral devices 118, linking component 210 may be selectively connected to only a subset of peripheral devices 118. In another example, gaming machine 202 may also include a keypad so that a player may enter a PIN for increased security. In still another example, instead of using a card and a card reader 212, gaming machine 202 may include a radio frequency receiver, an infrared frequency receiver, a magnetic device detector, or any similar device known to those skilled in the art that may retrieve or receive the unique identifier associated with a player from a corresponding device, such as a wireless transmitter, assigned to a player by the gaming facility. Alternatively, instead of or in addition to using a card and a card reader 212, gaming machine 202 may include a biometric device, such as a fingerprint scanner, for identifying each player.

Figure 3:
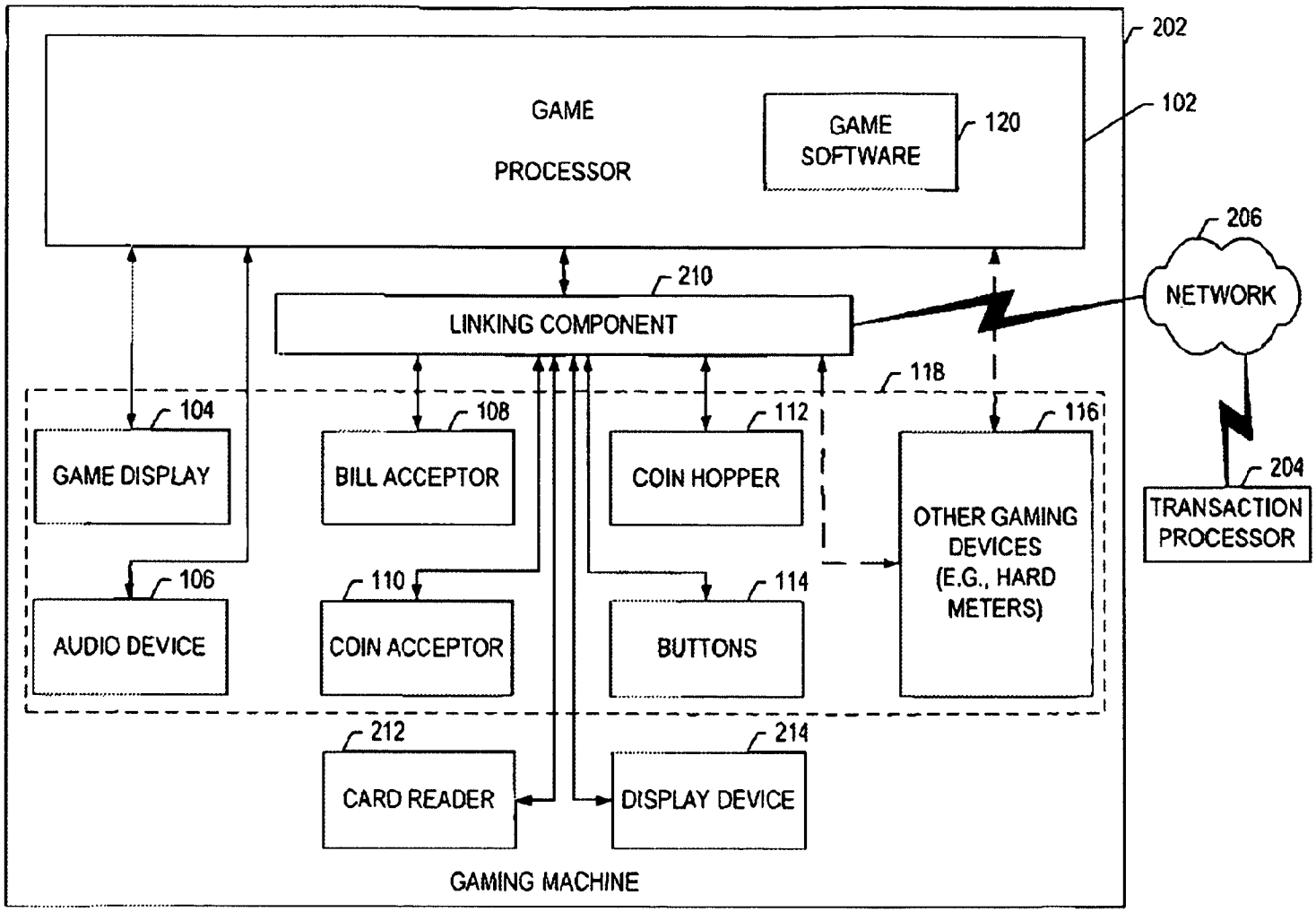
FIG. 3 is a more detailed block diagram of an exemplary gaming system in which a cash-only gaming machine is modified consistent with the present invention.

FIG. 3 is a more detailed block diagram of an exemplary gaming system in which a cash-only gaming machine is modified consistent with the present invention. As shown in FIG. 3, gaming machine 100 may be modified by disconnecting one or more peripheral devices 118 from game processor 102 and connecting them instead to linking component 210. Linking component 210 is also connected to game processor 102. In addition, as shown in FIG. 3, a card reader 212 and a display device 214 may also be added to gaming machine 202 and connected to linking component 210.

One skilled in the art will appreciate that there are many different ways to disconnect peripheral devices 118 from game processor 102 and connect peripheral devices 118 and game processor 102 to linking component 210. For example, instead of completely rewiring the gaming machine, gaming machine 202 could include small (for example, 2"×2") pass-through connector boards, one for each peripheral device 118 that is to be connected to linking component 210. Each pass-through connector board accepts wires from a peripheral device 118, game processor 102, and linking component 210 and passes signals received from game processor 102 and peripheral device 118 to linking component 210.

Regardless the physical mechanism for connecting game processor 102 and peripheral devices 118 to linking component 210, linking component 210 preferably intercepts signals sent between game processor 102 and peripheral device 118 and emulates the communication protocol between game processor 102 and the particular peripheral device 118 so as to provide cashless gaming and other services that are transparent to both game processor 102 and peripheral device 118.

As shown in FIG. 3, linking component 210 may connect to only a subset of peripheral devices 118. For example, as shown in FIG. 3, linking component 210 need not be connected to game display 104 or audio device 106. In addition, some of the other gaming devices 116, such as hard meters, may connect to game processor 102 either directly or though linking component 210, as shown by the dotted lines in FIG. 3.

Figure 4:
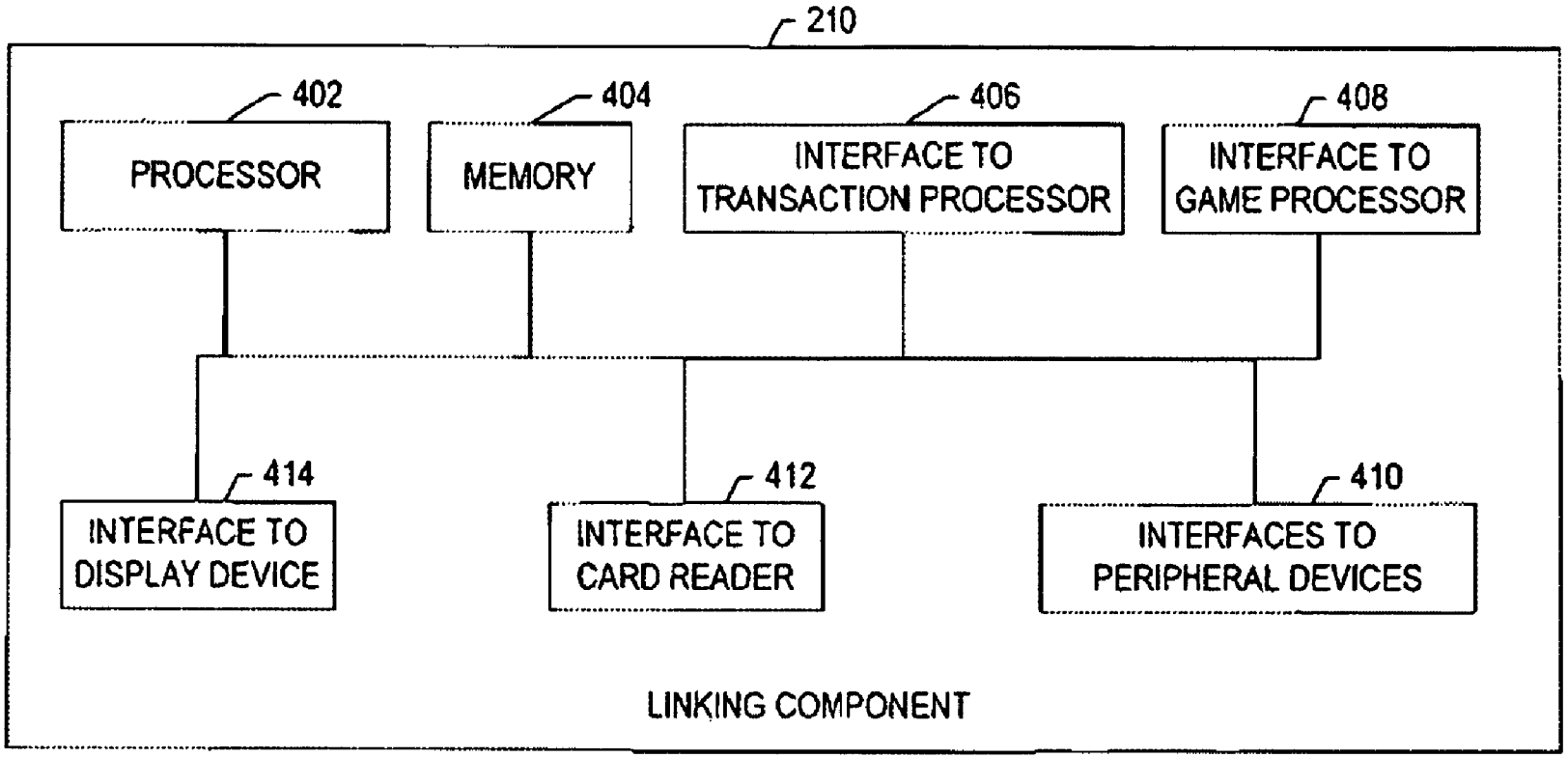
FIG. 4 is a block diagram of an exemplary linking component consistent with the present invention.

FIG. 4 is an exemplary block diagram of an exemplary linking component 210 consistent with the present invention. As shown, linking component 210 may include a processor 402, a memory 404, and interfaces 406, 408, 410, 412, and 414.

Memory 404 may include read only memory (ROM), random access memory (RAM), and/or flash memory. It may also include software instructions to provide cashless gaming and other services, such as player tracking. For example, the instructions may include instructions to intercept and emulate or relay signals sent between the game processor 102 and peripheral devices 118. Processor 402 may execute these instructions.

Interfaces 406, 408, 410, 412, and 414 facilitate communication between linking component 210 and other components in gaming system 200. Interface to transaction processor 406 enables linking component 210 to communicate with transaction processor 204. In one embodiment, interface 406 includes an Ethernet interface. Interface to game processor 408 enables linking component 210 to communicate with game processor 102. Linking component 210 also includes interfaces to peripheral devices 410 (e.g., one for each peripheral device 118 connected to linking component 210), which enable linking component 210 to communicate with peripheral devices 118. Interface to the card reader 412 enables linking component 210 to communicate with card reader 212 and interface to display device 414 enables linking component 210 to communicate with display device 214. In one embodiment, interfaces 408, 410, 412, and 414 include serial interfaces.

Although not shown, it will be apparent to one skilled in the art that linking component 210 may include additional components, such as additional interfaces. Moreover, it will be apparent to one skilled in the art that some of the interfaces may be combined and that linking component 210 may include only a subset of the components shown in FIG. 4.

Figure 5:
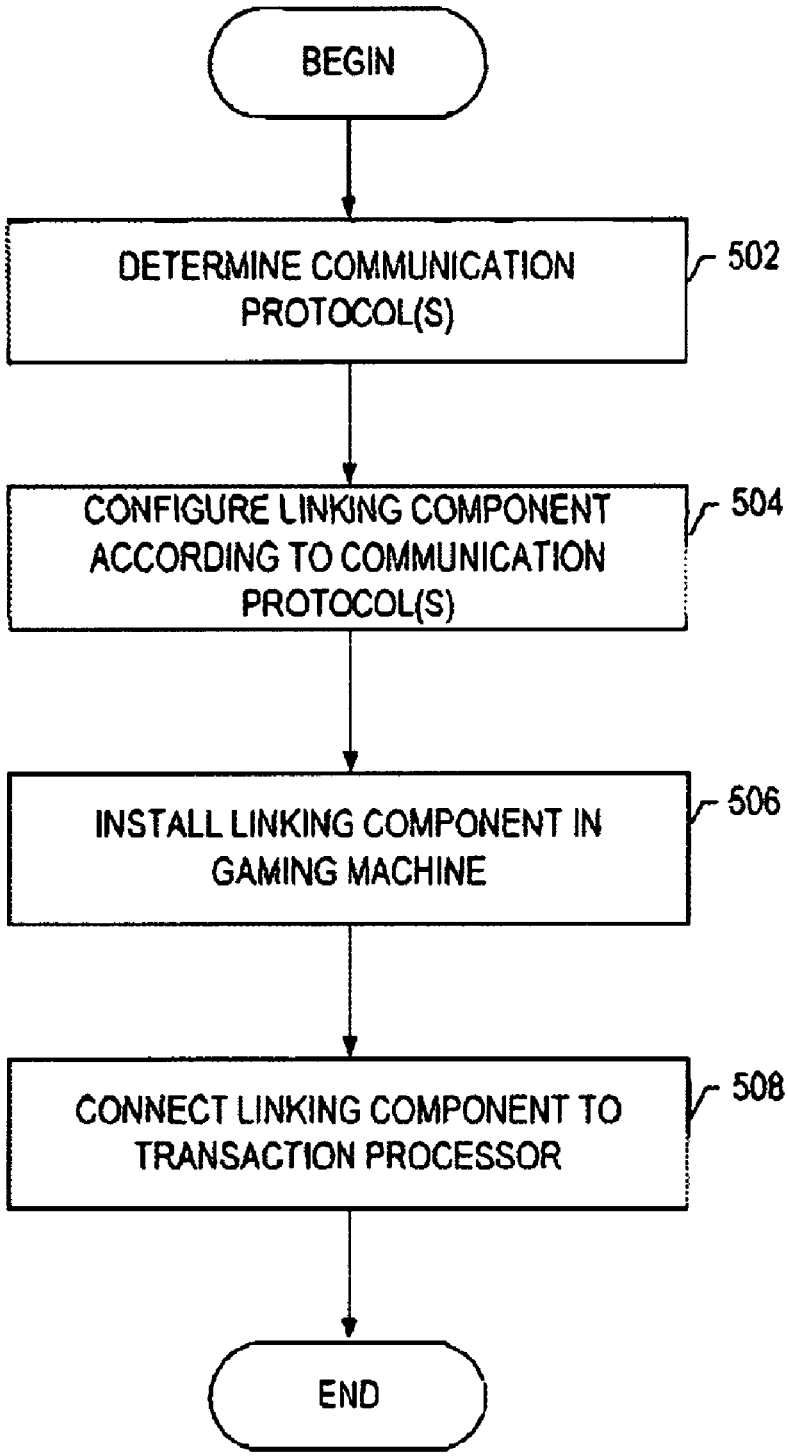
FIG. 5 is a flowchart illustrating how a gaming machine may be modified to provide additional services, such as cashless gaming, consistent with the present invention.

FIG. 5 is a flowchart illustrating how a cash-only gaming machine may be modified to provide additional services, such as cashless gaming and player tracking, consistent with the present invention. First, the installers determine the communication protocol used by each of the peripheral devices 118 and game processor 102 (step 502). The communication protocol may include a physical protocol, such as electrical voltage, or a logical protocol, such as a data stream carried over another physical protocol (e.g., RS-232). For example, to determine the protocol between a peripheral device 118, such as coin hopper 112, and game processor 102, the installers may use a voltage measuring device such as an oscilloscope to determine the voltage and waveform of the signals sent from coin hopper 112 to game processor 102 for each action that coin hopper 112 can take, and to determine the voltage and waveform of signals sent from game processor 102 to coin hopper 112 for each action that game processor 102 can take with respect to coin hopper 112.

After reverse-engineering the communication protocol, the installers may configure a linking component, such as linking component 210, to intercept and emulate communication between peripheral devices 118 and game processor 102 to provide cashless gaming and other services, such as player tracking (step 504). For example, the installers may configure the linking component to intercept signals from buttons 114, determine the meaning of the signals (e.g., bet one credit), send the wager amount to transaction processor 204, emulate a signal from coin acceptor 110 or bill acceptor 108 indicating that a player has input cash in the amount of the wager amount, and send the emulated signal to game processor 102.

After configuration, linking component 210 may be installed in a gaming machine 100 (step 506). As explained in the foregoing description, linking component 210 may be installed in the gaming machine in a variety of ways. Linking component 210 may then be connected to transaction processor 204 to provide cashless gaming and other services (step 508). If desired, the installers may also add card reader 212, display device 214, or any other peripheral device to gaming machine 100.

In accordance with one embodiment of the present invention, a player wishing to use gaming system 200 may open a player account. After opening an account, the player may receive an identifying device, such as a magnetic card, which stores a unique identifier assigned to the player.

The player may also deposit money into the account (or transfer money into the player account from a different financial account, such as a bank account). Transaction processor 204 stores the player's account information, including the player's unique identifier and account balance.

Figure 6A:
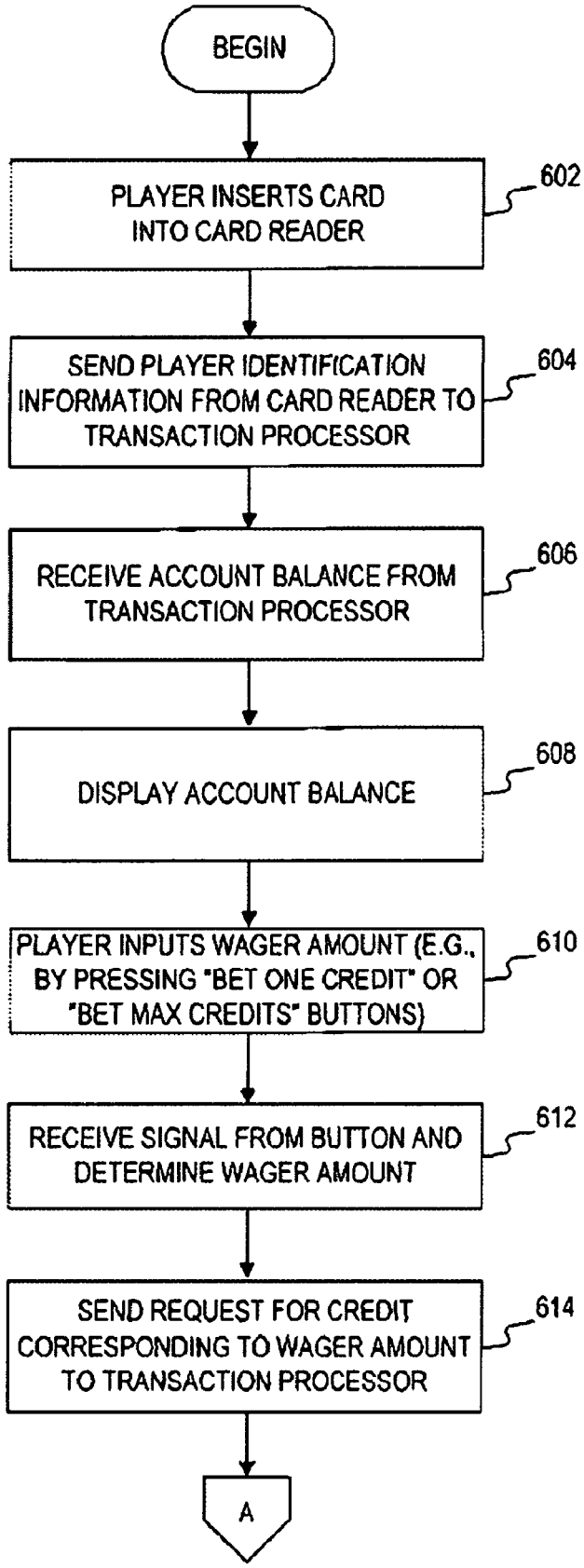
FIGS. 6A and 6B are flowcharts of an exemplary process for enabling cashless gaming consistent with the present invention.
Figure 6B:
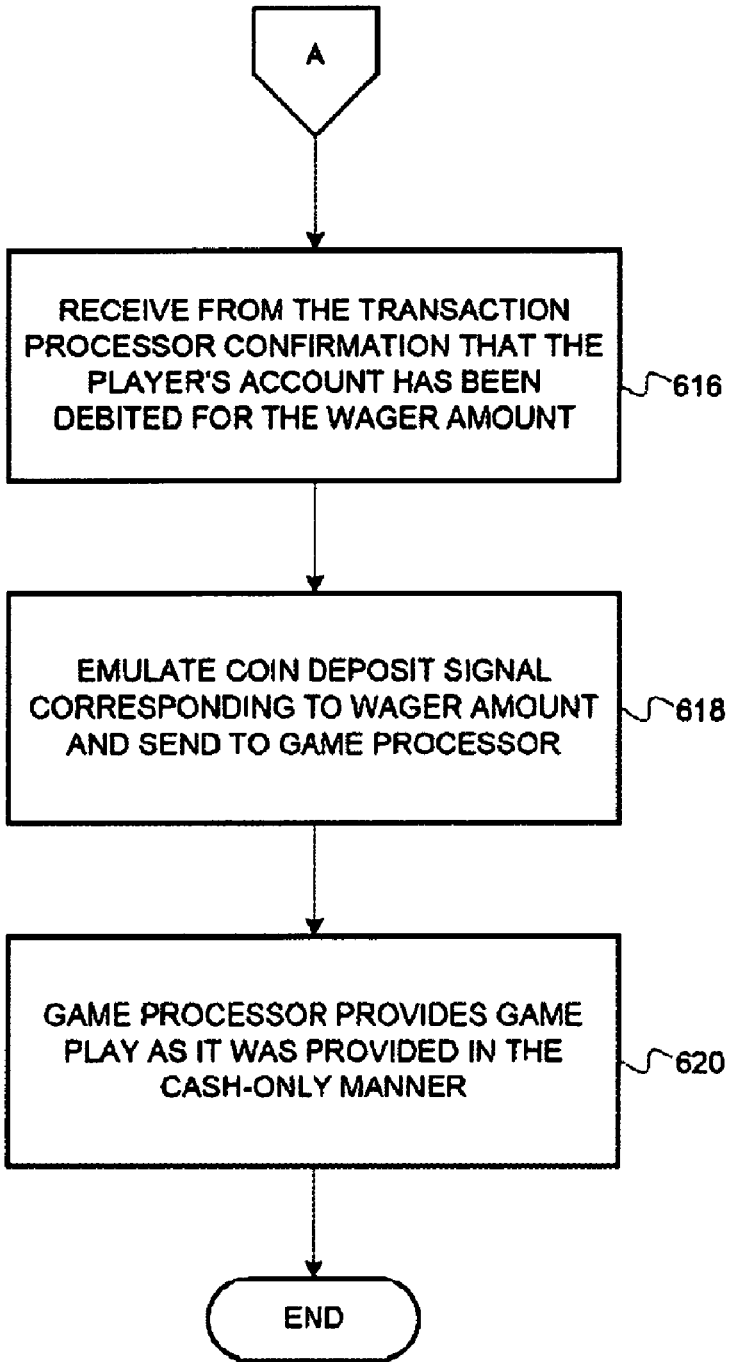

FIGS. 6A and 6B are flowcharts of an exemplary process for enabling cashless gaming consistent with the present invention. When a player inserts his card into card reader 212 (step 602), linking component 210 receives player identification information from the card reader 212, for example, via interface 412, and sends the player identification information to transaction processor 204 (step 604). In response, linking component 210 receives account information, such as the player's account balance, from transaction processor 204 (step 606). Linking component may in turn send the account balance to display device 214 for display (step 608). In this embodiment of the invention, no funds transfer has taken place at this point. The account balance has merely been communicated from transaction processor 204 to display device 214 via linking component 210.

After display device 214 displays the player's account balance, the player may select a wager amount, for example, by pressing the "Bet One Credit" or "Bet Maximum Credits" buttons on gaming machine 202 (step 610). The pressed button 114 will in turn generate a signal indicating that the player has pressed the button. Linking component 210, which is connected between buttons 114 and game processor 102, receives the signal from button 114, for example, via interfaces 410, and determines the wager amount based on the identification of the button pressed (e.g., "Bet One Credit" or "Bet Maximum Credits") (step 612). After determining the wager amount, linking component 210 sends a request for credit corresponding to the wager amount (e.g., one credit or maximum credits) to transaction processor 204 (step 614). In response, transaction processor 204 deducts an amount from the player's account balance and sends a confirmation indicating that the player's account has been debited for the wager amount, or in an alternative embodiment, transaction processor 204 may send the adjusted account balance to linking component 210 for display be display device 214. Linking component 210 receives the confirmation (step 616) and emulates a coin deposit signal corresponding to the wager amount to game processor 102 via interface 408 (step 618). From this point, the game is played as it was played in the cash-only manner (step 620). For example, game processor 102 will provide entertaining graphics on game display 104 (e.g., spinning reels) and provide a random game result. Consistent with the present invention, game processor 102 and buttons 114 perform as it did in a the cash-only manner, with no alterations due to the addition of linking component 210. In this way, the cashless gaming modifications are transparent to gaming machine 100 and to the player.

Figure 7:
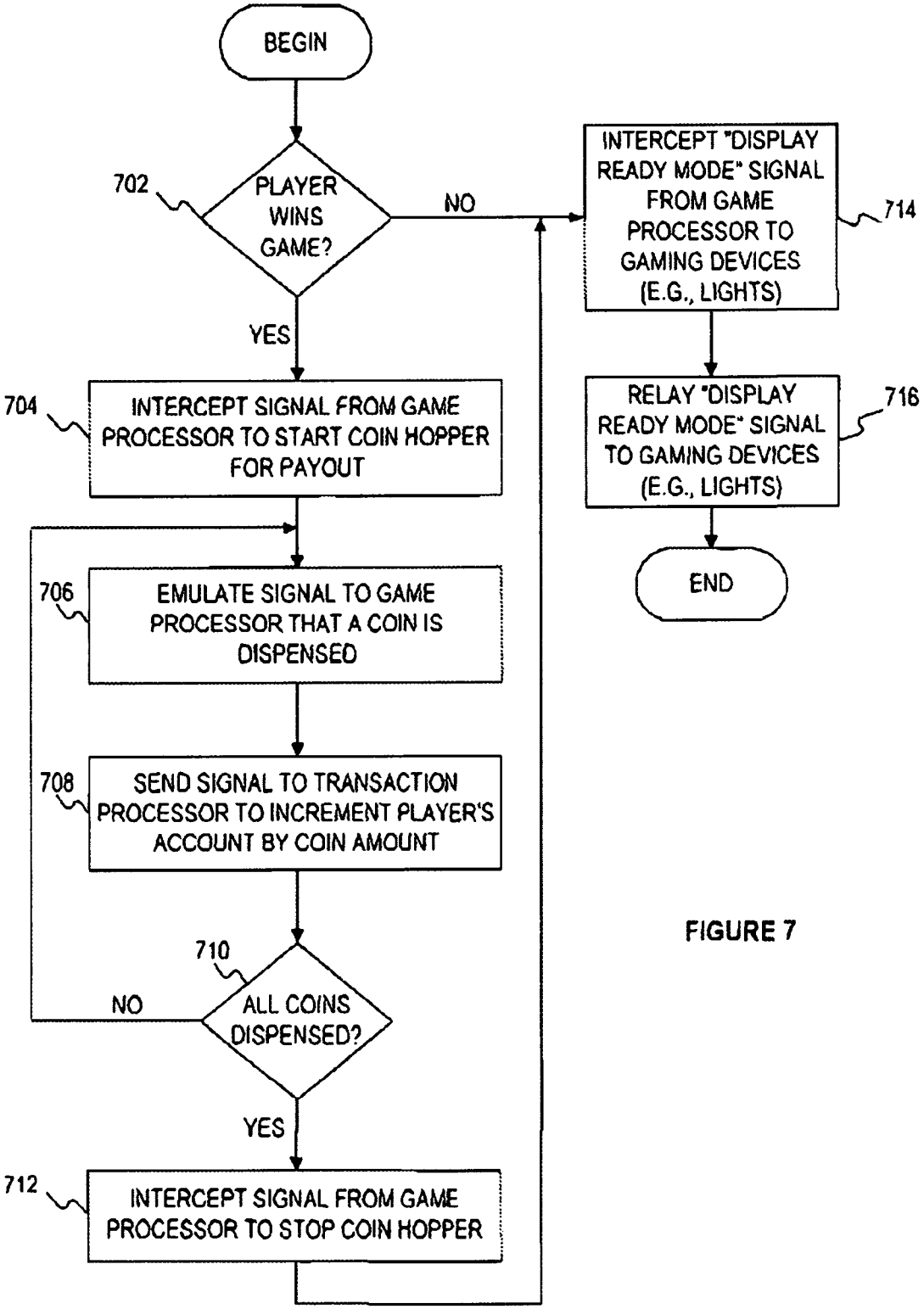
FIG. 7 is a flowchart of an exemplary process for processing game results in cashless gaming consistent with the present invention.

FIG. 7 is a flowchart of an exemplary process for processing game results in cashless gaming consistent with the present invention. If a player wins a game at gaming machine 202 (step 702), then game processor 102 may emit a signal to start coin hopper 112 for payout. So doing, game processor 102 performs exactly as it would in cash-based gaming. Linking component 210 intercepts the signal from game processor 102 (step 704) and emulates a signal back to game processor 102 that a coin has been dispensed (step 706). The coin dispense signal received by game processor 102 appears to be coming from coin hopper 112 as in cash-only operation.

To accomplish the cashless payout, linking component 210 sends a signal to transaction processor 204 to increment the player's account by the amount of the coin that would have been dispensed by coin hopper 112 (step 708). Although not shown, linking component 210 may receive a confirmation from transaction processor 204 that the player's account has been incremented.

If all the coins have yet to be dispensed (step 710), then the process (steps 706, 708, and 710) repeats. In this way, game processor 102 may count the number of "coins" dispensed to ensure that a player receives the proper payout, just as it would in traditional coin play. Once all of the coins have been dispensed (step 710), game processor 102 may send a signal to stop coin hopper 112, which signal is intercepted by linking component 210 (step 712).

Once the payout is complete, or if the player did not win the game (step 702), game processor 102 may send a "display ready mode" signal to lights 116 and/or audio device 106 to display an attract mode, which indicates to the player that the machine is ready for another game. Linking component 210 may receive the "display ready mode" signal (step 714) and emulate or relay that signal to lights 116 and/or audio device 106 (step 716). Accordingly, it may appear to game processor 102 and peripheral devices 118 that gaming machine 202 is operating in the cash-only manner to provide a payout to a player. In reality, however, the winning amount is credited to the player's account by transaction processor 204, thus providing cashless gaming.

Figure 8:
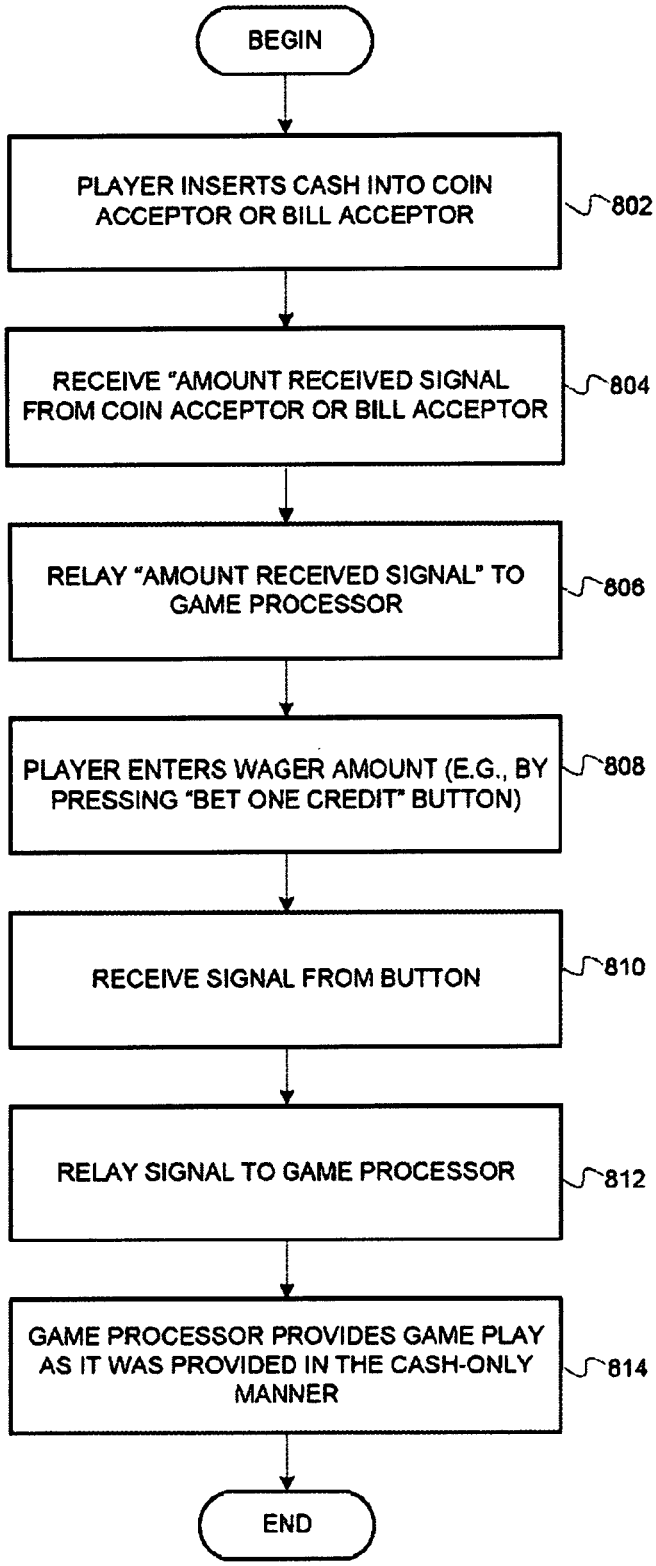
FIG. 8 is a flowchart of an exemplary process for enabling cash gaming consistent with the present invention.

In addition to providing cashless gaming, system 200 may also preserve the ability of a player to use cash when desired. FIG. 8 is a flowchart of an exemplary process for enabling cash gaming consistent with the present invention. When a player inserts cash, such as a coin, bill, or a token (step 802), coin acceptor 110 or bill acceptor 108 may send a signal with the amount received to game processor 102. Linking component 210 may intercept this signal (step 804) and relay the signal to game processor 102 (step 806). Then, when a player presses one of buttons 114, such as "Bet One Credit" or "Bet Maximum Credits" (step 808), linking component 210 may receive the signal from button 114 (step 810), and relay that signal to game processor 102 (step 812). At this point, the game is played as it was played in the cash-only manner (step 814). In this way, a gaining machine with linking component 210 can provide both cash and cashless play, affording players the maximum amount of flexibility, without any modification necessary to game processor 102. In fact, it will be apparent to one skilled in the art that a gaming machine with linking component 210 can provide cash gaming, cashless gaming, or a combination of both.

Figure 9:
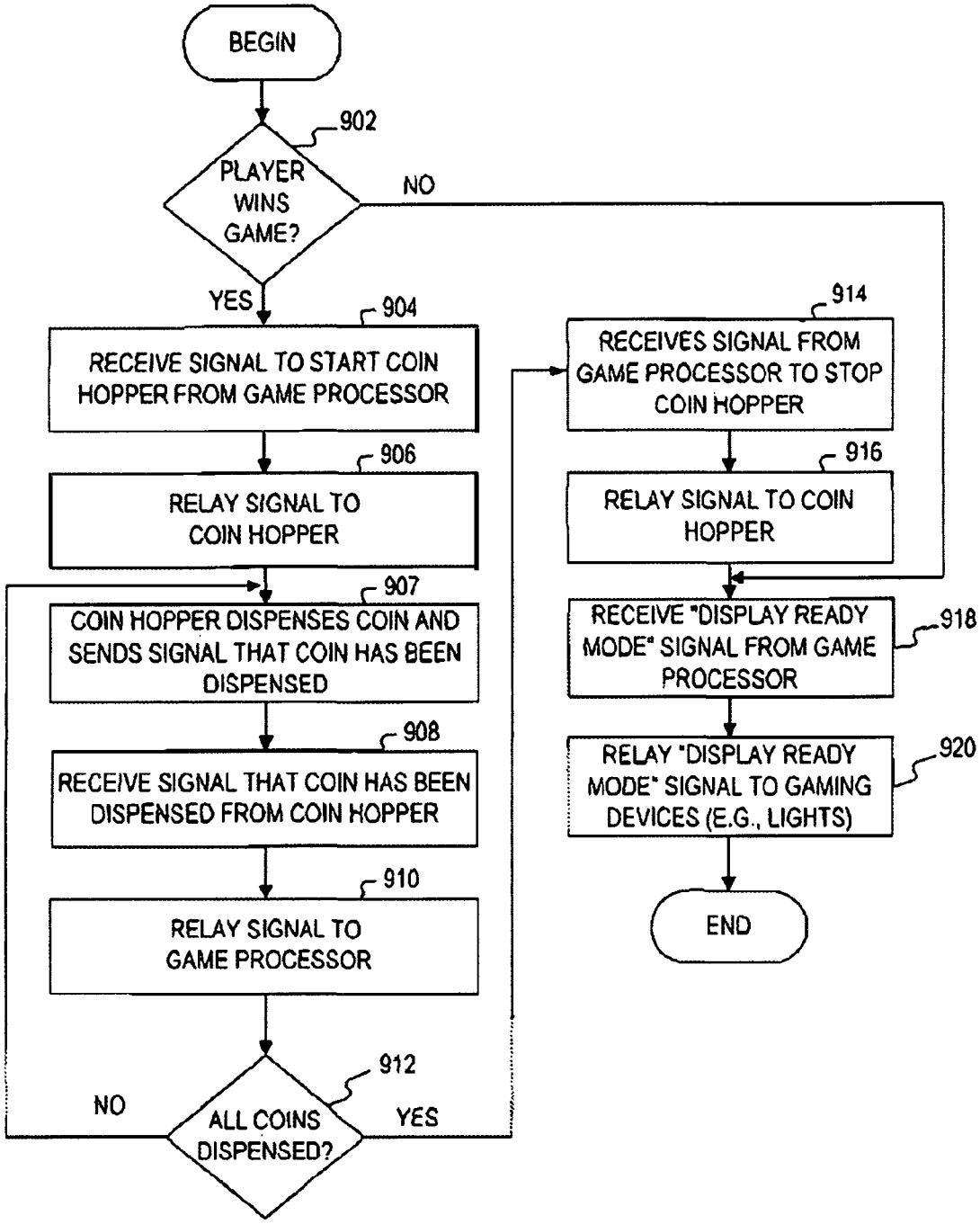
FIG. 9 is a flowchart of an exemplary process for processing a game result in cash gaming consistent with the present invention.

FIG. 9 is a flowchart of an exemplary process for processing a game result in cash gaming consistent with the present invention. If a player wins the game (step 902), game processor 102 may send a signal to start coin hopper 112 for a payout. Linking component 210 may receive that signal (step 904) and relay that signal to coin hopper 112 (step 906). The signal relayed to coin hopper 112 appears to coin hopper 112 as if it came directly from game processor 102. Thus, the presence of linking component 210 does not alter the operation of coin hopper 112 or any other peripheral devices 118.

Upon receiving the signal from linking component 210, coin hopper 112 may dispense a coin and send a signal that a coin has been dispensed (step 907). Linking component 210 may intercept the "coin dispense" signal (step 908) and relay the signal to game processor 102 (step 910). If all the coins have not yet been dispensed (step 912), then the process (steps 907, 908, 910, and 912) repeats. Game processor 102 is thus able to count the coins dispensed to ensure that the player receives the proper payout, as in cash-only gaming machine operation.

Once all the coins have been dispensed (step 912), game processor 102 may send a signal to stop coin hopper 112. Linking component 210 may intercept the signal to stop coin hopper 112 (step 914) and relay that signal to coin hopper 112 (step 916). The coin hopper may in turn stop dispensing coins.

Once the payout is complete, or if the player did not win the game, game processor 102 may send a "display ready mode" signal to lights 116 and/or audio device 106 to display attract mode. Linking component 210 may intercept the "display ready mode" signal (step 918) and relay that signal to lights 116 and/or audio device 106 (step 920). In this way, coin play can proceed as normal despite the installation of linking component 210 into gaming machine 100.

Figure 10:
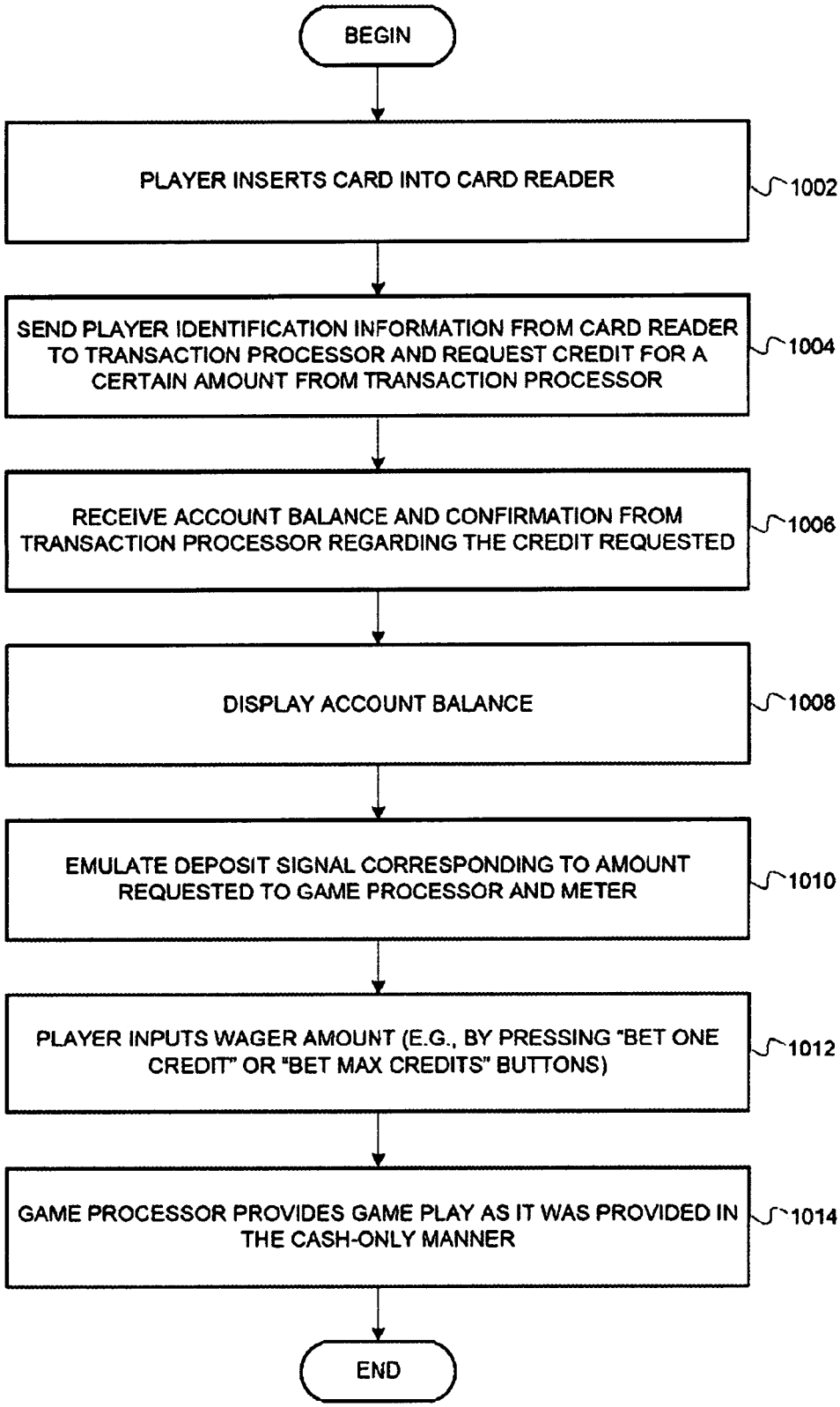
FIG. 10 is a flowchart of another exemplary process for enabling cashless gaming consistent with the present invention.

FIG. 10 is a flowchart of another exemplary process for enabling cashless gaming consistent with the present invention. When a player inserts his card into card reader 212 (step 1002), linking component 210 receives player identification information from the card reader 212, for example, via interface 412, and sends the player identification information to transaction processor 204 and requests a credit for a certain amount from transaction processor 204 (step 1004). The amount requested by linking component 210 may depend on the gaming facility or player preference.

If the player's account has sufficient balance for the requested amount, transaction processor 204 may debit the player's account for the requested amount and send a confirmation to linking component 210 along with the player's account balance. On the other hand, if the player's account does not have sufficient balance, transaction processor 204 may notify linking component 210 of that fact or debit the player's account for the amount of the player's balance and send that amount to linking component 210 along with the player's account balance.

Linking component 210 may receive the account balance and confirmation from transaction processor 204 (step 1006) and may in turn send the account balance to display device 214 for display (step 1008). After sending the account balance to display device 214 for display, linking component 210 may emulate a money deposit signal (appearing as if it is coming from, for example, bill acceptor 108) to game processor 102 and to a credit meter 116 on gaming machine 202 corresponding to the amount debited from the player's account (step 1010). In response, credit meter 116 may display the number of credits available to the player (e.g., equivalent to the amount debited). In addition, game processor 102 may either activate the appropriate bet buttons 114 or display buttons on game display 104 if game display 104 is a touch screen video monitor so that the player can select a wager amount. The buttons that are activated or displayed may depend on the amount of money that was debited from the player's account. For example, if game processor 102 can activate or display the following bet buttons: "Bet 1 credit," Bet 5 credits," and "Bet 10 credits" and each credit is equivalent to a dollar, game processor 102 may activate or display all these buttons if $20 was debited from the player's account. On the other hand, if only $5 was debited from the player's account, then game processor 102 may only activate or display the "Bet 1 credit" and "Bet 5 credits" buttons.

The player may select a wager amount by selecting one of the displayed or activated buttons (step 1012) and from this point, the game is played as it was played in the cash-only manner (step 1014). For example, game processor 102 will provide entertaining graphics on game display 104 (e.g., spinning reels, black jack, poker, and bingo) and provide a random game result.

In this embodiment, if a player wins a game, game processor 102 may send a signal to credit meter 116 to increment it for the amount of the win. Linking component 210 may intercept this signal and relay it to credit meter 116 without updating the player's account. Linking component 210 may allow credits to accumulate in credit meter 116 and may transfer the credits to transaction processor 204 when the player selects the cash out option, for example, by pressing the "Cash Out" button 114 or ejecting his card from card reader 212.

Moreover, in this embodiment, linking component 210 may monitor credit meter 116 (or even track the amount of credits separately or in addition to credit meter 116) and may request a credit for an additional amount from transaction processor 204 if linking component 210 detects that credit meter 116 is running out of credits or does not have any credits left.

Depending on the gaming facility and/or gaming machine 202, the process shown in FIGS. 6A-6B or FIG. 10 may be used. For example, if gaming facility uses gaming machine 202 that includes, for example, touch screen video monitors for accepting player inputs, then the process shown in FIG. 10 may be used. On the other hand, if gaming facility uses gaming machine 202 that includes a video monitor and buttons 114, then the process shown in FIGS. 6A-6B may be used.

Although the foregoing description explained only some of the possible processes performed by gaming machine 202, other processes will be apparent to one skilled in the art. For example, gaming machine 202 may payout outstanding credits to a player by increasing the player's account balance instead of directing coin hopper 112 to dispense coins (even during cash gaming). In addition, it will be apparent to one skilled in the art that the processes shown in the various figures may be modified without departing from the scope of the present invention. For example, instead of sending several signals to transaction processor 204 to increment player's account by a coin amount for the number of coins that need to be dispensed (step 708 in FIG. 7), linking component 210 may send only a single signal to increment player's account by an amount equal to the total number of coins that need to be dispensed.

Figure 11:
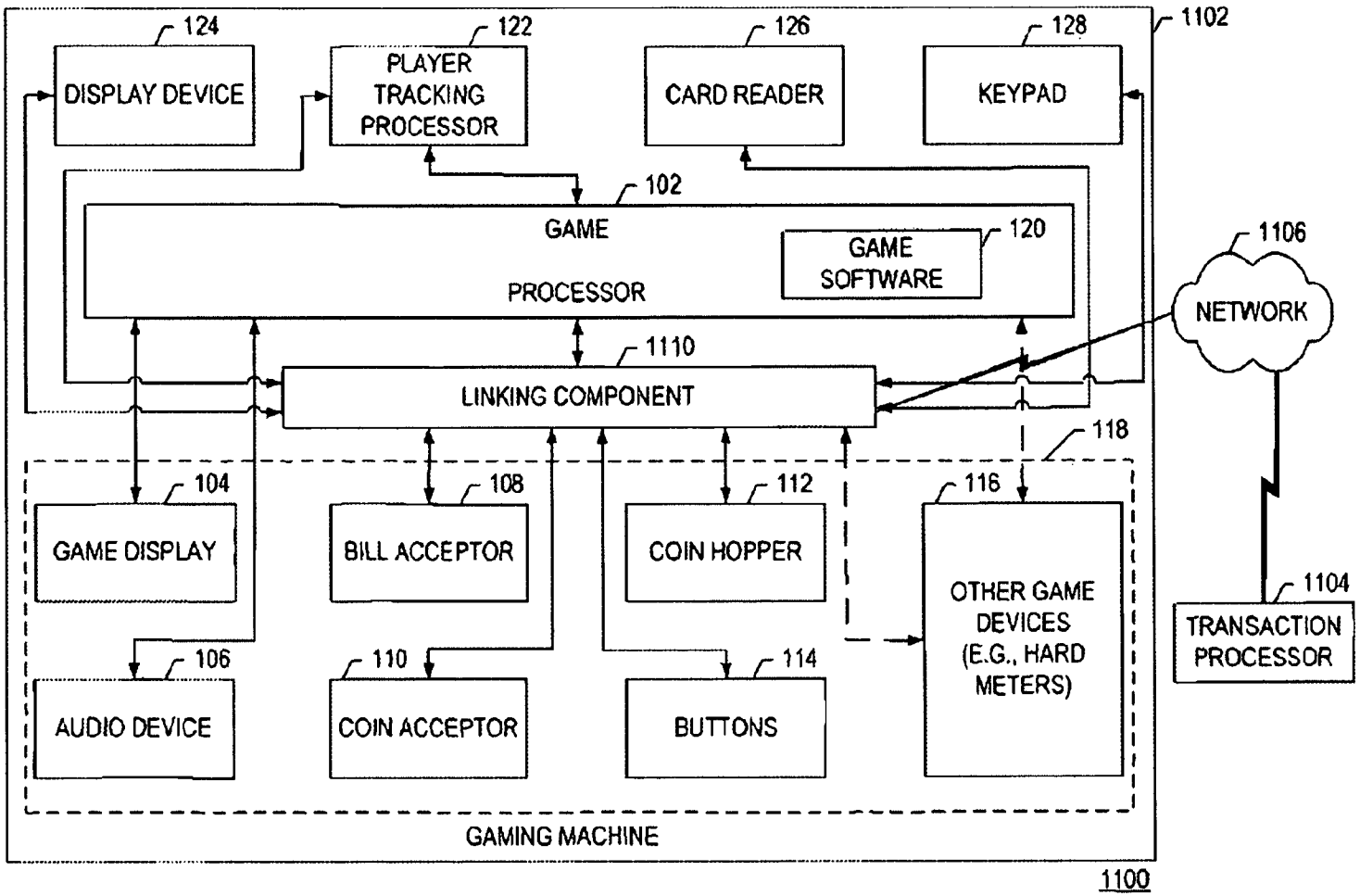
FIG. 11 is a block diagram of an exemplary gaming system in which a cash-only and player tracking gaming machine is modified consistent with the present invention.

Moreover, it will be apparent to one skilled in the art that methods and systems consistent with the present invention may also be used to modify other gaming machines, such as the cash-only and player tracking machine 130 shown in FIG. 1B. FIG. 11 is a block diagram of an exemplary gaming system 1100 in which a cash-only and player tracking gaming machine is modified consistent with the present invention. System 1100 may include gaming machine 1102 and a transaction processor 1104, which may be interconnected via network 1106. Gaming machine 1102 is similar to gaming machine 130 and thus only the differences will be described here. Gaming machine 1102 may include a linking component 1110 in addition to all the components shown in gaming machine 130. Linking component 1110 may be similar to linking component 210. Transaction processor 1104 may include a computer similar to transaction processor 204 and network 1006 may include a network similar to network 206. Although not shown, system 1100 may also include a player tracking computer, which is connected to player tracking processor 122, and provides player tracking functions.

To convert gaming machine 130 into a machine that provides cashless gaming and other services, display device 124, card reader 126, and keypad 128 may be connected to linking component 1010 instead of player tracking processor 122. In addition, player tracking processor 122 may be connected to linking component 1110. Like linking component 210, linking component 1110 may facilitate communication between the various gaming devices by intercepting and relaying or emulating signals sent between these devices. Moreover, when a card is inserted in card reader 126, linking component 1110 may communicate with transaction processor 1104 to provide cashless gaming and may communicate with player tracking processor 122 to provide player tracking functions. In this manner, the conversion of a gaming machine to a cashless gaining machine and a machine that may provide other services, such as e-commerce, is transparent to game processor 102.

Systems and methods consistent with the present invention enable a gaming machine to provide additional services, such as cashless gaming and player tracking, and, if desired, to provide cash gaming. In this way, players have the maximum flexibility of how to input and receive funds, increasing playing time and speed. If a player chooses to play in the original cash manner, the gaming machine appears no different to the player. Indeed, the game processor and peripheral devices detect no discernable difference due to the presence of a linking component.

Moreover, methods and systems consistent with the present invention allow a cash-only gaming machine to be modified to provide cashless gaming and other services with no modifications to existing game software. This makes gaming machine adaptation economical, efficient and applicable to the maximum number of existing game machines. Moreover, since there are no modifications to the game processor, the game software does not need to be re-certified.

It will be apparent to one skilled in the art that various modifications may be made to systems and methods consistent with the present invention without departing from the scope of the present invention. For example, although most of the foregoing description describes how a cash-only, gaming machine may be modified to provide cashless gaming using account-based payment, it will be apparent to one skilled in the art that methods and systems consistent with the present invention may also provide cashless gaming using credit cards, using electronic funds transfer, and using tickets or coupons as described in U.S. Pat. Nos. 4,636,951, 5,265,874, 5,290,033, 5,429,361, 5,470,079, and/or 6,048,269, all of which are incorporated herein by reference. For example, if a cash-only gaming machine is modified to accept tickets or coupons, a ticket/coupon reader and/or a printer for generating tickets/coupons may be added to a gaming machine along with a linking component. Moreover, it will be apparent to one skilled in the art that systems and methods consistent with the present invention may be used to modify a gaming machine that already provides cashless gaming in one form to provide another form of cashless gaming. For example, if a gaming machine already provides cashless gaming by using tickets or coupons, systems and methods consistent with the present invention may be used to also provide account based gaming at such a gaming machine.

In addition, the above-noted features and principles of the present invention may be implemented in various system or network configurations to provide automated and computational tools to provide cashless gaming and other services. Such configurations and applications may be specially constructed for performing the various processes and operations of the invention or they may include a general purpose computer or computing platform selectively activated or reconfigured by program code to provide the necessary functionality. The processes disclosed herein are not inherently related to any particular computer or other apparatus, and may be implemented by a suitable combination of hardware, software, and/or firmware. For example, various general purpose machines may be used with programs written in accordance with teachings of the invention, or it may be more convenient to construct a specialized apparatus or system to perform the required methods and techniques.

The present invention also relates to computer readable media that include program instruction or program code for performing various computer-implemented operations based on the methods and processes consistent with the present invention. The media and program instructions may be those specially designed and constructed for the purposes of the invention, or they may be of the kind well-known and available to those having skill in the computer software arts. The media may take many forms including, but not limited to, non-volatile media, volatile media, and transmission media. Non-volatile media includes, for example, optical or magnetic disks. Volatile media includes, for example, dynamic memory. Transmission media includes, for example, coaxial cables, copper wire, and fiber optics. Transmission media can also take the form of acoustic or light waves, such as those generated during radio-wave and infra-red data communications. Examples of program instructions include both machine code, such as produced by compiler, and files containing a high level code that can be executed by the computer using an interpreter.

While the foregoing detailed description of the invention and figures described exemplary embodiments, other embodiments are possible and changes may be made to the embodiments described without departing from the spirit and scope of the invention. Indeed, other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method of providing cashless gaming in a gaming machine that includes a game processor, a cash acceptor, and a cash dispenser, and a linking component, the method comprising:

receiving, in the linking component, a wager-selection communication from a peripheral device of the gaming machine indicating a selected wager amount;

sending, by the linking component, a deposit communication to the game processor indicating that a deposit has been made to the gaming machine, the deposit communication using a cash acceptor communication protocol used for communication between the cash acceptor and the game processor;

intercepting, by the linking component, a payout instruction from the game processor to the cash dispenser to dispense cash; and sending, by the linking component, a payout communication to the game processor indicating that a payout of cash has been made in an amount corresponding to the payout instruction, the payout communication using a cash dispenser communication protocol used for communication between the cash dispenser and the game processor.

2. The method of claim 1, further comprising:

sending, by the linking component, a signal to a transaction processor external to the gaming machine, the signal instructing the transaction processor to update a player account in the amount corresponding to the payout instruction.

3. The method of claim 1, further comprising:

sending, by the linking component, a signal to a transaction processor external to the gaming machine, the signal instructing the transaction processor to update a player account in an amount corresponding to the wager amount.

4. A gaming machine for providing cashless gaming, the gaming machine comprising:

a game processor;

a peripheral device;

a cash acceptor;

a cash dispenser; and a linking component, the linking component including, means for receiving a wager-selection communication from the peripheral device indicating a selected wager amount;

means for sending a deposit communication to the game processor indicating that a deposit has been made to the gaming machine, the deposit communication using a cash acceptor communication protocol used for communication between the cash acceptor and the game processor;

means for intercepting a payout instruction from the game processor to the cash dispenser to dispense cash; and means for sending a payout communication to the game processor indicating that a payout of cash has been made in an amount corresponding to the payout instruction, the payout communication using a, cash dispenser communication protocol used for communication between the cash dispenser and the game processor.

5. The gaming machine of claim 4, the linking component further including, means for sending a signal to a transaction processor external to the gaming machine, the signal instructing the transaction processor to update a player account in the amount corresponding to the payout instruction.

6. The gaming machine of claim 4, wherein the linking component further including, means for sending a signal to a transaction processor external to the gaming machine, the signal instructing the transaction processor to update a player account in an amount corresponding to the wager amount.

7. A method of providing cashless gaming in a gaming machine that includes a game processor and a cash acceptor, the method comprising:

receiving a wager communication indicating a wager made at the gaming machine;

sending a request corresponding to the wager to a transaction processor external to the gaming machine, wherein the transaction processor maintains a player's account;

receiving a confirmation from the transaction processor indicating that an amount corresponding to the wager has been deducted from the player's account;

emulating a deposit communication between the cash acceptor and the game processor, the deposit communication representing deposit of cash in the amount of the wager; and sending the deposit communication to the game processor.

8. The method of claim 7, further comprising:

intercepting a payout instruction from the game processor to a cash dispenser to dispense cash;

emulating a dispensing communication representing cash dispensing in an amount corresponding to the payout instruction;

sending the dispensing communication to the game processor; and sending a deposit credit instruction to the transaction processor instructing the transaction processor to increment the player's account by an amount corresponding to the payout instruction.

9. A gaming machine for providing cashless gaming, comprising:

a game processor;

a cash acceptor; and a linking component, the linking component including, means for receiving a wager communication indicating a wager;

means for sending a request corresponding to the wager to a transaction processor external to the gaming machine, wherein the transaction processor maintains a player's account;

means for receiving a confirmation from the transaction processor indicating that an amount corresponding to the wager has been deducted from the player's account;

means for emulating a deposit communication between the cash acceptor and the game processor, the deposit communication representing a deposit of cash in the amount of the wager; and means for sending the deposit communication to the game processor.

10. The gaming machine of claim 9, the linking component further including, means for intercepting a payout instruction from the game processor to a cash dispenser to dispense cash;

means for emulating a dispensing communication representing cash dispensing in an amount corresponding to the payout instruction;

means for sending the dispensing communication to the game processor; and means for sending a deposit credit instruction to the transaction processor instructing the transaction processor to increment the player's account by an amount corresponding to the payout instruction.

11. A gaming machine for providing cashless gaming, comprising:

a game processor;

a cash acceptor; and a linking component, the linking component including, a wager-receiving interface configured to receive a wager communication indicating a wager made at the gaming machine;

a transaction processor interface configured to send a request corresponding to the wager to a transaction processor external to the gaming machine, wherein the transaction processor maintains a player's account, the transaction processor interface further configured to receive a confirmation from the transaction processor indicating that an amount corresponding to the wager has been deducted from the player's account;

a linking component processor configured to emulate a deposit communication between the cash acceptor and the game processor, the deposit communication representing deposit of cash in the amount of the wager; and a game processor interface configured to send the deposit communication to the game processor.

12. The gaming machine of claim 11, the game processor interface further configured to receive a payout instruction from the game processor to a cash dispenser to dispense cash and, in response thereto, the linking component processor configured to emulate a dispensing communication representing cash dispensing in an amount corresponding to the payout instruction.

13. The gaming machine of claim 12, the linking component processor further configured to send an increment communication to the transaction processor to increment the player's account by an amount corresponding to the payout instruction.

14. A method for providing cashless gaming, the method comprising:

intercepting a peripheral device communication designed to go from a peripheral device in a gaming machine to a game processor in the gaming machine;

instructing a transaction processor external to the gaming machine to adjust a player's account balance, wherein the transaction processor maintains the player's account balance; and emulating a communication using a communication protocol used for communication between the peripheral device and the game processor; and sending the communication to the game processor.

15. The method of claim 14, further comprising:

intercepting a game processor communication designed to go from the game processor to the peripheral device.

16. The method of claim 15, further comprising:

emulating a communication using a communication protocol used for communication between the peripheral device and the game processor in response to the game processor communication from the game processor.

17. A gaming machine for providing cashless gaming, the gaming machine comprising:

a game processor;

a peripheral device; and a linking component, the linking component including means for intercepting a peripheral device communication designed to go from a peripheral device in a gaming machine to a game processor in the gaming machine;

means for instructing a transaction processor external to the gaming machine, wherein the transaction processor maintains a player's account balance, the instructing to adjust the player's account balance; and means for emulating a communication using a communication protocol used for communication between the peripheral device and the game processor; and means for sending the communication to the game processor.

18. The gaming machine of claim 17, wherein the linking component further includes means for intercepting a game processor communication designed to go from the game processor to the peripheral device.

19. The gaming machine of claim 18, wherein the linking component further includes means for emulating a communication using a communication protocol used for communication between the peripheral device and the game processor in response to the communication from the game processor.

20. The method of claim 1, wherein the communicating using the cash acceptor communication protocol depends on at least one of a voltage and a waveform.

21. The method of claim 1, wherein the cash acceptor communication protocol is determined using a reverse engineering process.

22. The method of claim 21, wherein the reverse engineering process is performed with at least one of a voltage reading device and a waveform reading device.

23. The gaming machine of claim 4, wherein the communicating using the cash acceptor communication protocol depends on at least one of a line voltage and a signal waveform.

24. The gaming machine of claim 4, wherein the cash acceptor communication protocol is determined using a reverse engineering process.

25. The gaming machine of claim 24, wherein the reverse engineering process is performed with at least one of a voltage reading device and a waveform reading device.

26. A method for converting a cash-only gaming machine into a machine that is capable of providing cashless play, the gaming machine including a game processor and a peripheral device, the method comprising:

connecting a linking component between the game processor and the peripheral device;

determining a communication protocol used for communication between the game processor and the peripheral device;

receiving, by the linking component, a communication signal intended for the game processor from the peripheral device; and sending, by the linking component, a new communication signal to the peripheral device using the determined communication protocol.

27. The method of claim 26, further comprising:

disconnecting the game processor from the peripheral device.

28. The method of claim 26, further comprising:

connecting a card reader and a display device to the gaming machine.

29. The method of claim 26, further comprising:

connecting the linking component to a transaction processor external to the gaming machine, wherein the transaction processor maintains player account information including a player account balance.

30. The method of claim 26, wherein communicating using the communication protocol depends on at least one of a line voltage and a signal waveform.

31. The method of claim 30, wherein determining the communication protocol includes the use of at least one of a voltage reading device and a waveform reading device.

32. A converted cash-only gaming machine that is capable of providing cashless play, comprising:

a game processor;

a peripheral device;

a linking component connected between the game processor and the peripheral device, wherein the linking component receives a communication signal intended for the game processor from the peripheral device and sends a new communication signal using a communication protocol used for communication between the game processor and the peripheral device.

33. The gaming machine of claim 32, further comprising:

a card reader; and a display device.

34. The gaming machine of claim 32, wherein the linking component is connected to a transaction processor external to the gaming machine, wherein the transaction processor maintains player account information including a player account balance.

35. The gaming machine of claim 32, wherein communicating using the communication protocol depends on at least one of a line voltage and a signal waveform.

36. A system for providing cashless gaming, the system comprising:

a transaction processor configured to maintain player account information for a plurality of players, wherein the account information includes player identifiers and account balances; and a gaming machine configured to include, a game processor;

a peripheral device; and a linking component interconnected between the game processor and the peripheral device, wherein the linking component is configured to send a player identifier to the transaction processor and configured to emulate signals between the game processor and the peripheral device to provide cashless gaming in a manner that is transparent to the game processor.

37. The system of claim 36, wherein the linking component includes, one or more interfaces configured to receive signals from the game processor and the peripheral device;

a memory configured to include instructions for intercepting a communication signal from the game processor, instructions for intercepting a communication signal from the peripheral device, and instructions for sending a new communication signal using the communication protocol used for communication between the game processor and the peripheral device; and a processor configured to execute the instructions.

38. A method for providing cashless play at a gaming machine, the gaming machine including a game processor and a peripheral device, the method comprising:

connecting a linking component between the game processor and the peripheral device;

determining a communication protocol used for communication between the game processor and the peripheral device;

receiving, by the linking component, a communication signal intended for the game processor from the peripheral device; and sending, by the linking component, a new communication signal to the peripheral device using the determined communication protocol.

39. The method of claim 38, further comprising:

disconnecting the game processor from the peripheral device.

40. The method of claim 38, further comprising:

connecting a card reader and a display device to the gaming machine.

41. The method of claim 38, further comprising:

connecting the linking component to a transaction processor external to the gaming machine, wherein the transaction processor maintains player account information including a player account balance.

42. The method of claim 38, wherein communicating using the communication protocol depends on at least one of a line voltage and a signal waveform.

43. The method of claim 42, wherein determining the communication protocol includes the use of at least one of a voltage reading device and a waveform reading device.

44. A gaming machine that is capable of providing cashless play, the gaming machine comprising:

a game processor;

a peripheral device;

a linking component connected between the game processor and the peripheral device, wherein the linking component is configured to receive a communication signal intended for the game processor from the peripheral device and configured to send a new communication signal to the game processor using a communication protocol used for communication between the game processor and the peripheral device.

45. The gaming machine of claim 44, further comprising:

a card reader; and a display device.

46. The gaming machine of claim 44, wherein communicating using the communication protocol depends on at least one of a line voltage and a signal waveform.

47. A method for tracking activity at a gaming machine, the gaming machine including a game processor and a peripheral device, the method comprising:

connecting a linking component between the game processor and the peripheral device;

collecting, by the linking component, player tracking data in a manner that is transparent to the game processor and the peripheral device, the player tracking data including at least one of player activity, game activity, and gaming machine activity; and sending the player tracking data to a player tracking computer external to the gaming machine.

48. A gaming machine that is capable of tracking activity, the gaming machine comprising:

a game processor;

a peripheral device; and a linking component connected between the game processor and the peripheral device, wherein the linking component is configured to collect player tracking data in a manner that is transparent to the game processor and the peripheral device, the player tracking data including at least one of player activity, game activity, and gaming machine activity, the linking component further configured to send the player tracking data to a player tracking computer external to the gaming machine.

49. A method for providing additional services at a gaming machine, the gaming machine including a game processor and a peripheral device, the method comprising:

connecting a linking component between the game processor and the peripheral device;

determining a communication protocol used for communication between the game processor and the peripheral device; and emulating a communication between the game processor and the peripheral device using the communication protocol to provide additional services at the gaming machine in a manner that is transparent to the game processor and the peripheral device, wherein the additional services include at least one of player tracking, amenity services, e-commerce, and locating a player in a gaming facility.

* * * * *